United States Patent [19]

de Sivry et al.

[11] Patent Number: 4,476,605

[45] Date of Patent: Oct. 16, 1984

[54] ROTARY METAL BRUSH FOR REMOVING SUBMERGED ANTI-CORROSIVE COVERING AND METHOD FOR USING THE SAME

[75] Inventors: Bruno de Sivry, Paris; Guy Hervé; Claude Colas, both of Nantes; Jean-Louis Caputi, Paris, all of France

[73] Assignee: Compagnie Francaise des Petroles, Paris, France

[21] Appl. No.: 455,625

[22] Filed: Jan. 4, 1983

Related U.S. Application Data

[63] Continuation of Ser. No. 297,464, Aug. 28, 1981, abandoned.

[30] Foreign Application Priority Data

Sep. 9, 1980 [FR] France ..... 80 19430

[51] Int. Cl.[3] ..... A46B 3/08; A46B 13/02

[52] U.S. Cl. ..... 15/179; 15/104.04; 15/200; 114/222

[58] Field of Search ..... 15/88, 104.04, 181, 15/198, 200, 179, DIG. 3; 114/222

[56] References Cited

U.S. PATENT DOCUMENTS 2,995,401 8/1961 Peterson ..... 15/DIG. 3
3,013,289 12/1961 Sasena ..... 15/181
3,599,264 8/1971 Smith, Jr. ..... 15/181
4,137,594 2/1979 Arnal et al. ..... 15/181

FOREIGN PATENT DOCUMENTS 117183 12/1899 Fed. Rep. of Germany ..... 15/181
1006829 4/1957 Fed. Rep. of Germany ... 15/DIG. 3

*Primary Examiner*—Peter Feldman
*Attorney, Agent, or Firm*—Sughrue, Mion, Zinn, Macpeak & Seas

[57] ABSTRACT

The present invention relates to a heavy-duty metal brush particularly, but not exclusively, for removing anti-corrosion materials from an immersed metal surface.

The brush comprises a compact assembly of radial strands of, for example, steel wire, which are applied against each other and are clamped between two metal plates, the diameter of which is less than that of the assembly of strands by at most 20 mm.

In use of such a brush for removing an anticorrosion covering, the brush may be rotated at a circumferential speed of the order of 17 meters per second and may be mounted on a carriage adapted to roll over the surface on rollers and which is displaced either automatically or manually.

11 Claims, 3 Drawing Figures

ROTARY METAL BRUSH FOR REMOVING SUBMERGED ANTI-CORROSIVE COVERING AND METHOD FOR USING THE SAME

This is a continuation of application Ser. No. 297,464 filed Aug. 28, 1981, now abandoned.

The invention relates to a metal brush which is capable of performing very heavy duties and in particular of removing anti-corrosion materials, and it also relates in particular to the use of such a brush in carrying out an operation for the removal of an anti-corrosion covering under water.

An anti-corrosion covering is applied, for example, to the external metal surface of a pipe which is to be immersed such as a pipe for conveying petroleum products. This anti-corrosion covering can consist of a bituminous product, such as coal pitch or petroleum pitch, or of a synthetic resin, such as polyethylene, polyurethane or epoxy resin, optionally reinforced by glass fibres.

It is known to remove this anti-corrosion covering with impact tools. Attempts to mechanise the operation have been made by using chains which are caused to rotate and which strike the anti-corrosion covering, but this system only works with a brittle covering (pitch at low temperature) and at a very slow speed of advance.

It could be envisaged to use scrapers which are inclined relative to a perpendicular to the surface of the anti-corrosion covering, and which plane the covering, but, on the one hand, because of this inclination, it would be necessary to provide preliminary circumferential grooves used as a starting point for longitudinal grooves, and, on the other hand, final cleaning of the surface would be essential.

According to the invention there is provided a rotary metal brush having radial strands which are mounted so as to be applied against one another, substantially without a gap, to form a compact assembly, and which are axially clamped between two metal plates, the two metal plates laterally covering the assembly of radial strands completely up to an external circumference, the diameter of which is less than the external diameter of the assembly of strands mounted on the brush by at most 20 mm.

Preferably, the diameter of the cross-section of each strand wire is of the order of 0.8 mm. The strands are advantageously made of steel hardened at 220/260 hbar.

At least one disc made of an elastic material, for example rubber, may be inserted between each metal plate and the assembly of strands.

The strands can be left bare or may be embedded in a plastomer or an elastomer.

The strands advantageously have a free length of not more than about 50 mm before installation of the plates.

It has been found that good operating conditions are obtained, without necessitating excessively large driving powers, by using brushes of relatively small diameter and of relatively large width, and advantageously brushes having an external diameter of the order of 210 mm and an axial length of the order of 150 mm.

According to another aspect of the invention there is provided a method of using a brush as defined above in the removal of an anti-corrosion covering, especially under water, wherein the brush is driven at a circumferential speed of the order of 17 meters per second.

The force of application of the brush against the anti-corrosion covering is preferably of the order of 10 newtons per millimeter of axial length of the brush.

According to another aspect of the invention there is provided a method of using a brush as defined above, for example, to remove an anti-corrosion covering from a pipe, wherein the brush is mounted on a module which is capable of surrounding the pipe and which comprises at least one brush-holding carriage displaceable in a circumferential direction, the displacement being controlled by an operator, such as a diver, or automatically, means being provided for holding the brush against the pipe. In automatic control, the carriage also moves in a longitudinal direction.

It has been found that it is possible to perform very heavy duties and particularly to remove an anticorrosion covering for example as described above, especially under water, in a single operation which completely cleans the underlying surface, by using a rotary metal brush as described above according to the invention. The metal brush of the invention does not wear out rapidly and does not give rise to cavitation effects reducing the useful power.

Embodiments according to the invention will now be described, by way of example only, with reference to the accompanying drawings.

Figure 1:
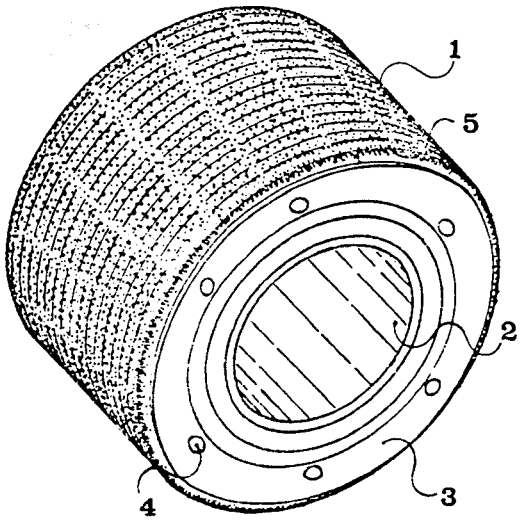
FIG. 1 shows, in perspective, an embodiment of a brush according to the invention.

FIG. 1 shows an assembly of strands 1, that is to say an assembly of bundles of steel wires, arranged radially one against another along a ring mounted on a metal sleeve 2. The fixing of these strands has not been shown because it can be conventional, for example they can be passed through holes in discs and the two parts can be bent radially outwards. These strands are in a staggered arrangement from one row to the next, so as to fill all the space on the ring.

The ring of strands is axially clamped between two metal end-plates 3. One of these end plates is visible in the perspective view of FIG. 1. The two plates are held in position clamping the ring of strands 1 by means of longitudinal bolts 4 welded to the plates 3. A rubber disc 5 is inserted between each plate 3 and the ring of strands 1.

The strands 1 extend radially beyond the plates by about 8 mm in the embodiment shown (external diameter of the assembly of mounted strands is about 16 mm more than that of the plates), which gives the ring of strands excellent strength. At the same time, the compactness of the ring of strands, reinforced by the insertion of the rubber discs 5, considerably reduces the pumping effect compared with that which would be produced by the rotation of a conventional metal brush under water, and makes it possible to use the brush in the immersed state.

Figure 2:
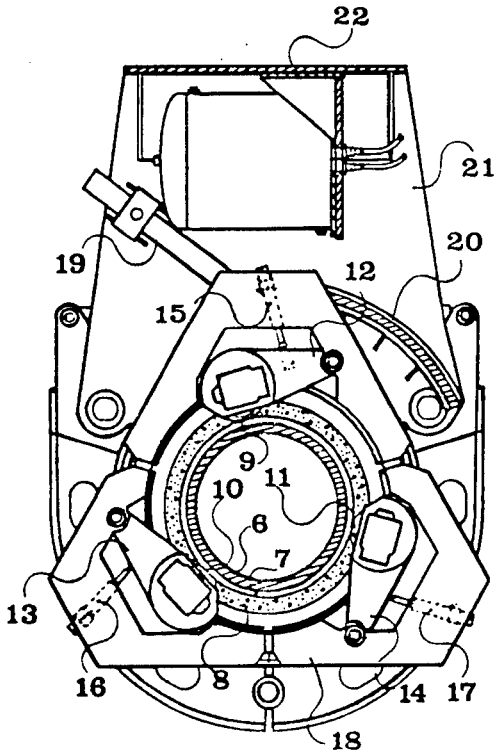
FIG. 2 shows a pipe together with three brushes according to the invention working on the pipe, the latter being shown in section.

This brush easily lends itself to the automation of operations for the removal of an anti-corrosion covering. FIG. 2 shows a pipe 6 during a brushing operation intended to remove the anti-corrosion covering 7, in a region where the concrete covering 8 has been removed beforehand. Three brushes 9, 10 and 11, each mounted on an articulated arm 12, 13, 14, are simultaneously caused to rotate by hydraulic or electric motors, the force with which they are applied to the pipe 6 being determined by jacks 15, 16, 17 acting on the arms 12, 13, 14. The assembly comprising the brushes 9, 10, 11, the arms 12, 13, 14 and the jacks 15, 16, 17 is mounted in a three-part rotary cage 18 which is caused to rotate, over an approximately 120° sector, by a jack 19 acting on a movable rack (not shown) via a toothed wheel (not shown) rolling over a fixed rack 20. The rotary cage 18 moves on a circular rail (not shown) which is formed by three cylindrical sectors and which is carried by a frame 21 fastened, in its upper part 22, to a carriage (not shown) for longitudinal displacement parallel to the axis of the pipe 6.

Figure 3:
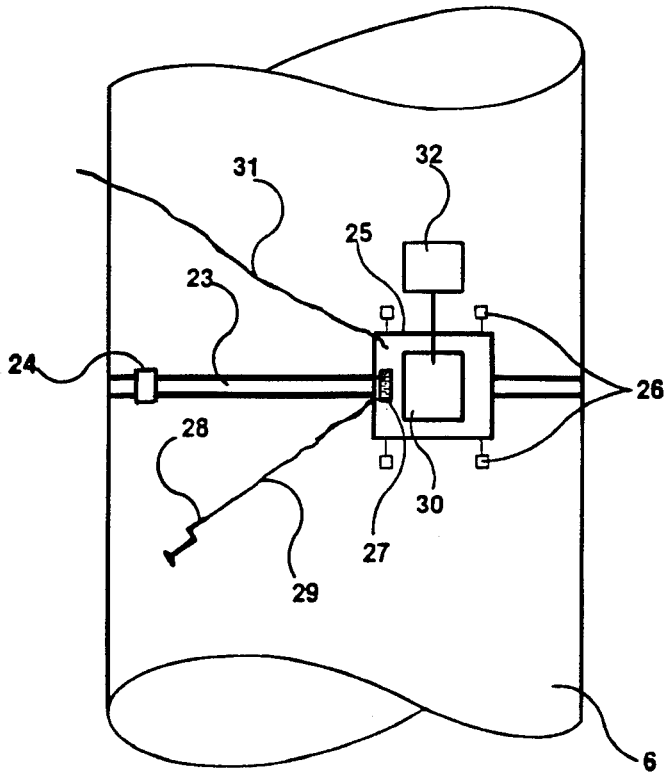
FIG. 3 shows a pipe together with an embodiment of a brush according to the invention used in an apparatus controlled by an operator.

FIG. 3 shows a system controlled by an operator, for example a diver. In this system, the module surrounding the pipe 6 comprises a device 23 of the kind consisting of a strap, chain or flexible ring, which is fixed directly to the pipe 6 by clamping by means of a device 24 for bringing the ends of this device 23 closer together. A carriage 25 is mounted on the device 23 and can roll over the pipe 6 via rollers 26, and it is displaced circumferentially by rotary means 27, of the kind consisting of a serrated wheel or toothed wheel, carried by the carriage and engaging with the device 23 to displace the carriage when the said means 27 is caused to rotate. This rotation, which could be automatic, is effected in this case by an operator by means of a handle 28 and a flexible transmission 29. The carriage 25 carries a hydraulic or electric motor 30 supplied by a lead 31. This motor 30 causes the rotation of a brush 32 as described above, means (not shown) being provided for applying the brush against the pipe 6 with the desired application force.

The number of brushes working simultaneously can obviously be different from that chosen in these examples. These applications do not in any case imply any limitation, it being possible for the brush according to the invention to be used for other purposes and mounted in other ways, in a manually or automatically controlled system.

What I claim is:

1. A rotary metal brush for removing an anticorrosion covering from an immersed metal surface, comprising:

two substantially circular metal plates;

a cylindrical assembly of radial steel wires;

means for axially clamping and compressing said cylindrical assembly of radial steel wires between said two metal plates;

the external diameter of said cylindrical assembly of radial steel wires being greater than the diameter of said metal plates by no more than 20 mm to provide substantial strength and rigidity to said steel wires to facilitate said removal of said anti-corrosion covering;

two discs made of an elastic material, said discs being inserted, respectively, between said two metal plates and said cylindrical assembly of radial steel wires to compress the radially outer free ends of said steel wires in an axial direction of said cylindrical assembly and form a rigid assembly of steel wires;

said assembly of radial steel wires forming a plurality of rows, said wires being staggered from one row to the next.

2. The brush as claimed in claim 1 wherein said radial steel wires are hardened between 220 and 260 hbar.

3. The brush as claimed in claim 1 wherein said cylindrical assembly of radial steel wires has an external diameter of about 210 mm and an axial length of about 150 mm.

4. The brush as claimed in claim 1 wherein said steel wires have a length of less than 50 mm.

5. The brush as claimed in claim 1 wherein sad clamping means comprises a plurality of longitudinal bolts, said bolts being welded to said plates.

6. The brush as claimed in claim 1 wherein a cross-sectional area of each of said steel wires is about 0.8 mm.

7. The brush as claimed in claim 1, wherein said radial steel wires are hardened between 220 and 260 hbar, said steel wires having a length of less than 50 mm, said clamping means comprising a plurality of longitudinal bolts, said bolts being welded to said plates.

8. The brush as claimed in claim 7, wherein a cross-sectional area of each of said steel wires is about 0.8 mm.

9. The brush as claimed in claim 1, wherein said cylindrical assembly of radial steel wires has an external diameter of about 210 mm and an axial length of about 150 mm, said clamping means comprising a plurality of longitudinal bolts, said bolts being welded to said plates.

10. The brush as claimed in claim 1 wherein the free ends of the wires extend radially beyond the circumference of said plates by no more than about 8 mm.

11. The brush as claimed in claim 7 wherein the free ends of the wires extend radially beyond the circumference of said plates by no more than about 8 mm.

* * * * *